US007369793B2

(12) United States Patent
Kumazawa

(10) Patent No.: US 7,369,793 B2
(45) Date of Patent: May 6, 2008

(54) BELT UNIT FOR IMAGE-FORMING APPARATUS

(75) Inventor: Kiyomitsu Kumazawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 73 days.

(21) Appl. No.: 11/362,252

(22) Filed: Feb. 27, 2006

(65) Prior Publication Data

US 2006/0193656 A1 Aug. 31, 2006

(30) Foreign Application Priority Data

Feb. 28, 2005 (JP) ..... 2005-054857

(51) Int. Cl.
*G03G 15/08* (2006.01)
*G03G 15/02* (2006.01)

(52) U.S. Cl. ..... 399/121; 399/116

(58) Field of Classification Search ..... 399/116, 399/121, 162, 303, 309, 312, 313
See application file for complete search history.

(56) References Cited

U.S. PATENT DOCUMENTS 4,674,858 A * 6/1987 Nagayama ..... 399/116
5,602,634 A * 2/1997 Uchida et al. ..... 399/313
6,493,533 B1 * 12/2002 Munakata ..... 399/303 X
7,187,887 B2 * 3/2007 Inaba ..... 399/116 X

FOREIGN PATENT DOCUMENTS

| | | |
|---|---|---|
| JP | 7-315614 | 12/1995 |
| JP | 8-123294 | 5/1996 |
| JP | 2001-13800 | 1/2001 |
| JP | 2004-109267 | 4/2004 |

* cited by examiner

*Primary Examiner*—Sandra L. Brase
(74) *Attorney, Agent, or Firm*—Banner & Witcoff, Ltd

(57) ABSTRACT

A belt unit is detachably mountable in an image-forming apparatus. The belt unit includes: at least two rollers, each having a roller shaft; an endless belt looped around the two rollers; and an outer frame disposed around the endless belt and having two roller-supporting walls rotatably supporting the rollers therebetween, the roller shafts of the rollers extending in a direction intersecting the roller-supporting walls.

15 Claims, 14 Drawing Sheets

UP
DOWN
FRONT
REAR
LEFT
RIGHT
36
80
85
81
85A
86B
38A
86C
39A
38
39
89
86A
83A
84B
83
84(83)
82
84C
63
68
37A
84A
37
83
85A

BELT UNIT FOR IMAGE-FORMING APPARATUS

CROSS REFERENCE TO RELATED APPLICATION

This application claims priority from Japanese Patent Application No. 2005-54857 filed Feb. 28, 2005. The entire content of this priority application is incorporated herein by reference.

TECHNICAL FIELD

The disclosure relates to an image-forming apparatus and a belt unit employed in the image-forming apparatus.

BACKGROUND

Conventional image-forming apparatuses employ various methods of transferring images, including a direct multi-transfer method, an intermediate transfer method, and a combination thereof. These image-forming apparatuses also employ various belts, including a photosensitive belt, a paper-conveying belt, and an intermediate transfer belt, depending on the system used in the image-forming apparatus.

Japanese unexamined patent application publication No. 2004-109267 has proposed a transfer system that is configured primarily of the paper-conveying belt, a drive roller, a tension roller, and a supporting member for supporting both rollers. The entire assembly including the belt, rollers, and supporting member can be treated as a single unit. Most of the major components, including the supporting member, are arranged within the belt, while half or more of the outer periphery of the belt is exposed.

SUMMARY

With this construction, it is possible to treat the rollers and the belt, and the group of components around the rollers and belt, as a single unit, thereby facilitating assembly and maintenance of the image-forming apparatus. However, incorporating various parts with diverse functions inside the unit increases the complexity of the construction, making it difficult to assemble the unit during production and to dismantle the unit for disposal.

In view of the foregoing, it is an object of the invention to provide a belt unit having a structure that facilitates assembly and disassembly.

In order to attain the above and other objects, the invention provides a belt unit that is detachably mountable in an image-forming apparatus, including: at least two rollers, each having a roller shaft; an endless belt looped around the two rollers; and an outer frame disposed around the endless belt and having two roller-supporting walls rotatably supporting the rollers therebetween, the roller shafts of the rollers extending in a direction intersecting the roller-supporting walls.

According to another aspect, the invention provides an image-forming apparatus, including: a main casing; an image forming unit detachably mounted in the main casing; and a belt unit that is detachably mounted in the main casing. The belt unit includes: at least two rollers, each having a roller shaft; an endless belt looped around the two rollers; and an outer frame disposed around the endless belt and having two roller-supporting walls rotatably supporting the rollers therebetween, the roller shafts of the rollers extending in a direction intersecting the roller-supporting walls.

According to another aspect, the invention provides a belt unit that is detachably mountable in an image-forming apparatus, including: a roller unit; an endless belt; and an outer frame. The roller unit includes at least two rollers. Each roller has a roller shaft. The roller shafts of the rollers are spaced from one another in a predetermined direction and are located on a predetermined imaginary plane. The roller unit has a pair of first opposite sides that are defined in the axial direction of the rollers on the predetermined imaginary plane and a pair of second opposite sides that are defined on the predetermined imaginary plane in a direction perpendicular to the axial direction of the rollers. The endless belt is looped around the rollers. The outer frame is disposed on the predetermined imaginary plane and surrounds the endless belt from all of the pair of first opposite sides and the pair of second opposite sides. The outer frame rotatably supports the rollers at the pair of first opposite sides.

BRIEF DESCRIPTION OF THE DRAWINGS

In the drawings:

FIG. 11(*b*) is an explanatory diagram showing a photosensitive belt.

DETAILED DESCRIPTION

Figure 1:
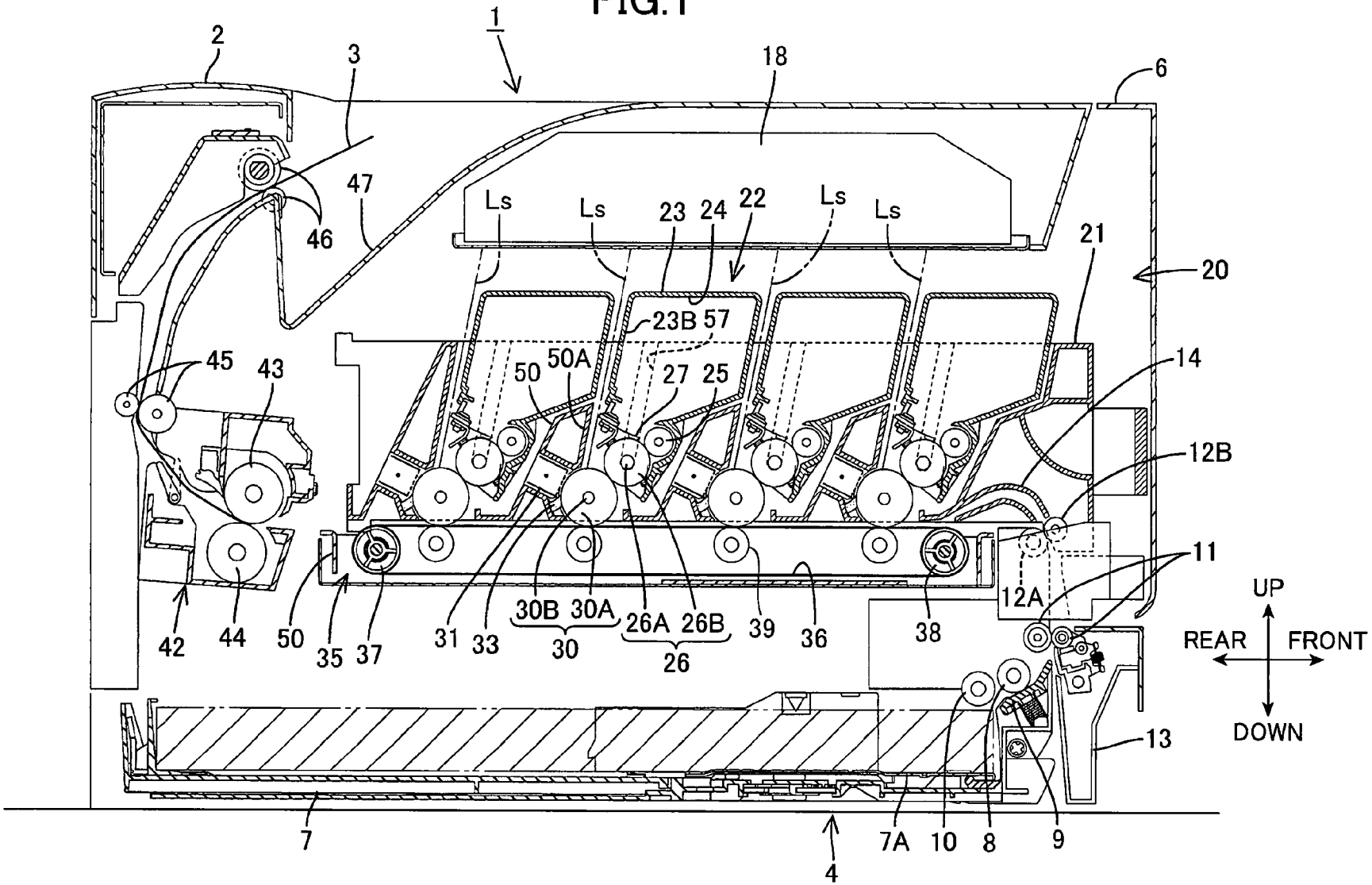
FIG. 1 is a side cross-sectional view of a laser printer according to a first embodiment.
Figure 2:
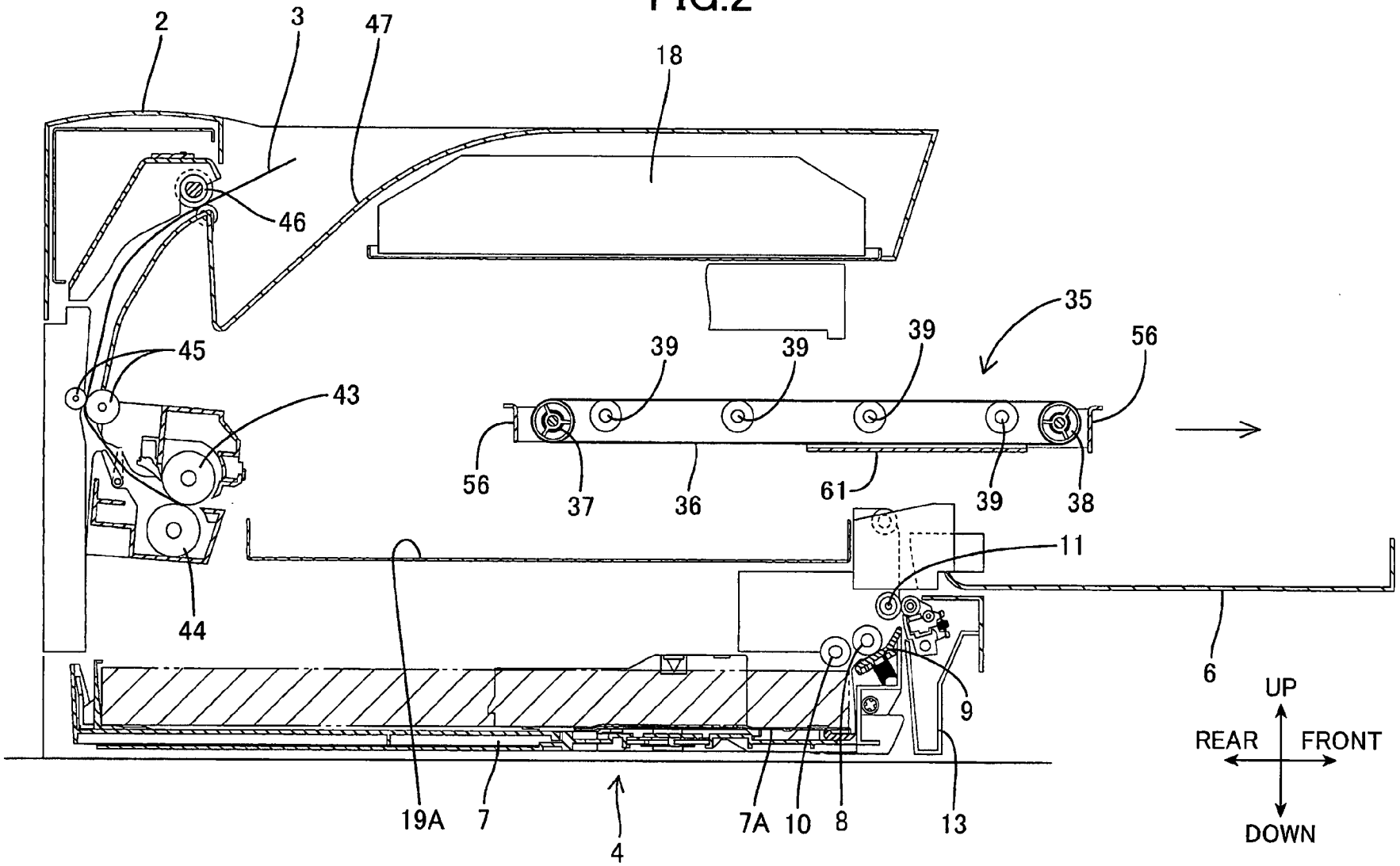
FIG. 2 is a side cross-sectional view of the laser printer according to the first embodiment when a front cover is in an open position.

A belt unit according to some aspects of the invention will be described while referring to the accompanying drawings wherein like parts and components are designated by the same reference numerals to avoid duplicating description.

First Embodiment

Next, a first embodiment of the invention will be described with reference to FIGS. 1 through 5. FIG. 1 is a side cross-sectional view showing the overall structure of a laser printer 1 according to the first embodiment of the invention. The laser printer 1 is a direct tandem type color laser printer having four photosensitive drums 30 corresponding to the colors black, cyan, magenta, and yellow.

As shown in FIG. 1, the laser printer 1 also includes a main casing 2 in which are provided a paper-feeding unit 4 for feeding sheets 3 of paper or another recording medium, a belt unit 35 for conveying the sheets 3, an image-forming unit 20 for forming images on the sheets 3 of paper that are supplied from the paper-feeding unit 4, and a scanning unit 18, which components in order from bottom to top. In the following description, the right side of the laser printer 1 in FIG. 1 will be referred to as the "front side," and a lateral direction orthogonal to the surface of the drawing will be referred to as the "width direction."

A front cover 6 capable of rotating open and closed is disposed on the front surface of the main casing 2. When in a closed position (see FIG. 1), the front cover 6 covers the front surface of the main casing 2 in a substantially vertical orientation. From this position, the front cover 6 can be rotated to an open position (see FIG. 2) at a substantially horizontal orientation by rotating the top end of the front cover 6 forward about the lower end of the front cover 6. By rotating the front cover 6 to this open position, the belt unit 35 and the image-forming unit 20 accommodated in the main casing 2 can be removed in a forward direction.

The laser printer 1 also includes a supporting plate 19A (see FIG. 2) configured of a metal plate positioned laterally with both front and rear ends bent upward at an angle of about 90°. The supporting plate 19A partitions the interior space of the main casing 2 to form a space for accommodating the belt unit 35 and the like and a space for accommodating a paper tray 7 described next.

The paper-feeding unit 4 includes the paper tray 7 detachably mounted in a bottom section of the main casing 2, a feeding roller 8 and a separating pad 9 disposed above a front end of the paper tray 7, a pickup roller 10 disposed to the rear of the feeding roller 8, a pair of paper dust rollers 11 disposed diagonally above and forward of the feeding roller 8, and a pair of registration rollers 12A and 12B disposed above the paper dust rollers 11.

The paper tray 7 has a shallow box shape for accommodating a stack of sheets 3 of paper on which images are to be formed. A front wall 13 is provided on the front end of the paper tray 7 at a position below the front cover 6 on the front surface of the main casing 2. By pulling the front wall 13 in a forward direction, the user can pull the paper tray 7 horizontally from the front of the main casing 2. A paper-pressing plate 7A is disposed in the bottom of the paper tray 7 for supporting the stacked sheets 3. The paper-pressing plate 7A is capable of rotating about the rear end thereof. A spring (not shown) is disposed beneath the front end of the paper-pressing plate 7A for urging the front end upward. Hence, the sheets 3 stacked in the paper tray 7 are urged upward on the front end thereof.

Through the urging force of the paper-pressing plate 7A, the topmost sheet of the sheets 3 stacked on the paper tray 7 is pressed against the pickup roller 10. The pickup roller 10 rotates and begins conveying this topmost sheet toward the feeding roller 8 and separating pad 9. When the sheet 3 becomes interposed between the feeding roller 8 and separating pad 9, the rotating feeding roller 8 conveys the sheet 3, while the separating pad 9 ensures that only one sheet is conveyed at a time. The feeding roller 8 conveys the sheet to the registration rollers 12A and 12B, during which time the paper dust rollers 11 removes paper dust from the sheet.

Of the registration rollers, the registration roller 12A is a drive roller while the registration roller 12B is a follow roller. The registration rollers 12A and 12B register the sheet 3 and subsequently convey the sheet 3 along a paper-conveying path 14 to the belt unit 35. The paper-conveying path 14 is an arc-shaped path formed in an accommodating section 21 of the image-forming unit 20 described later for conveying the sheet 3.

Figure 3:
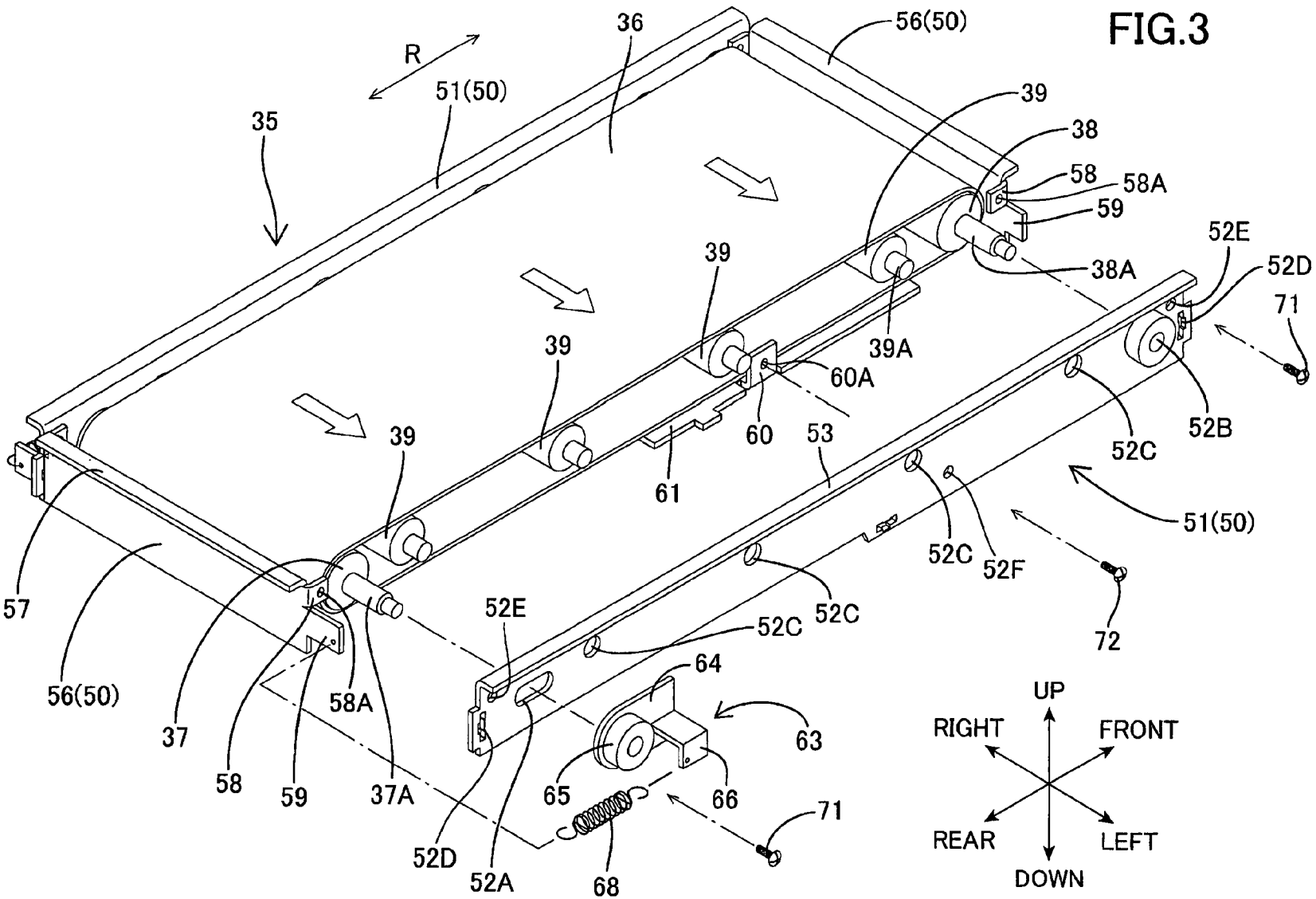
FIG. 3 is a perspective view of a belt unit according to the first embodiment.
Figure 4:
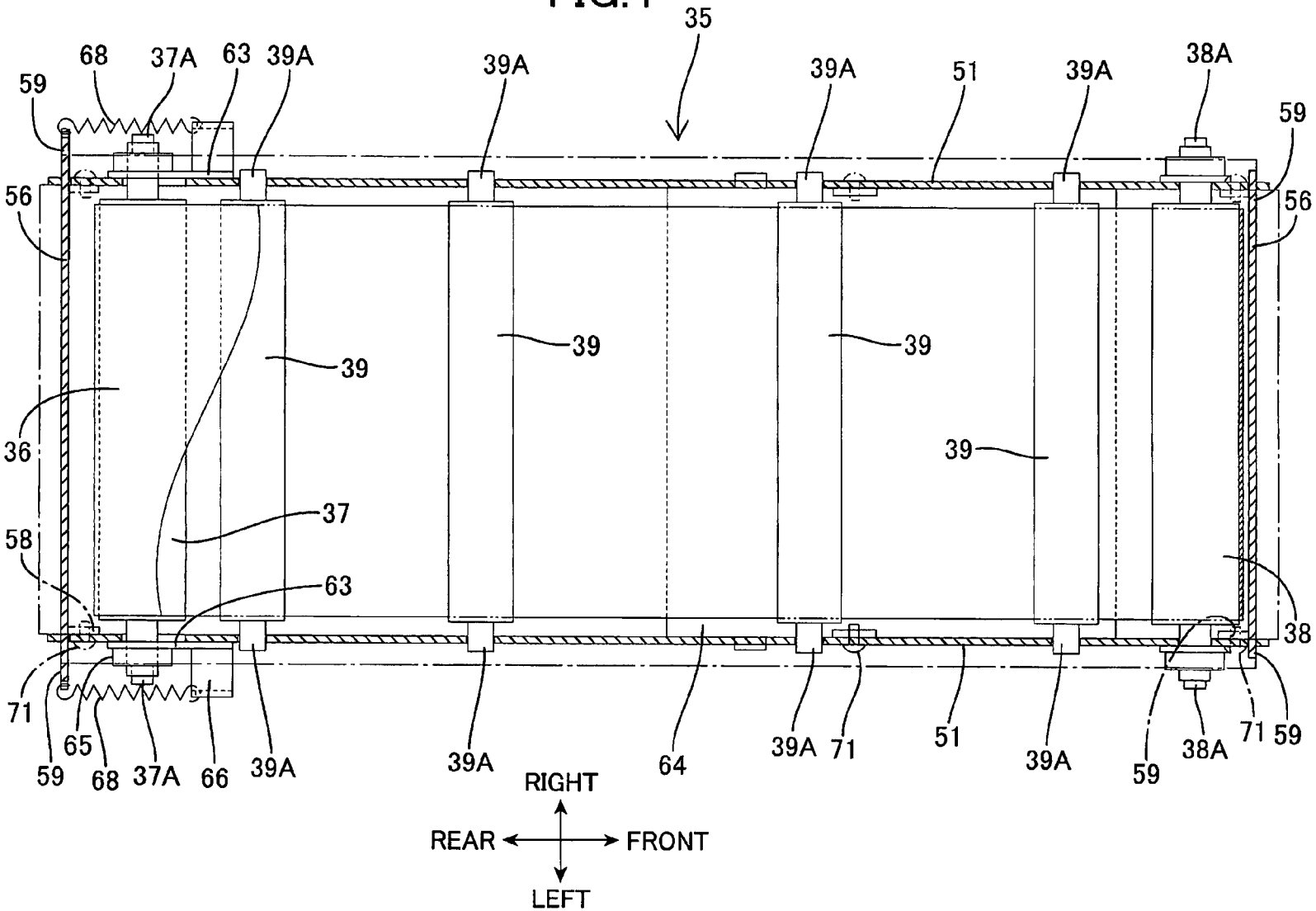
FIG. 4 is a plan view of the belt unit according to the first embodiment.

Next, the belt unit 35 will be described in greater detail. FIG. 3 is a perspective view and FIG. 4 a plan view of the belt unit 35.

As shown in the drawings, the belt unit 35 is primarily configured of a pair of belt-supporting rollers 37 and 38, an endless paper-conveying belt 36 looped around the belt-supporting rollers 37 and 38, and an outer frame 50 formed around the paper-conveying belt 36. In other words, the outer frame 50 surrounds all of the front, left, right, and rear sides of the paper-conveying belt 36. Since the belt unit 35 is symmetrical left-to-right (that is, symmetrical in the width direction of the laser printer 1), only the left side of the belt unit 35 will be described below.

The outer frame 50 includes a pair of roller-supporting walls 51 extending linearly in the paper-conveying direction (the direction indicated by arrows R in FIG. 3 and orthogonal to the axes of the rollers), and a pair of joining walls 56 joining corresponding ends of the roller-supporting walls 51. Thus, the pair of roller-supporting walls 51 confront the left and right sides of the paper-conveying belt 36, while the pair of joining walls 56 confront the front and rear sides of the paper-conveying belt 36. Both the roller-supporting walls 51 and joining walls 56 are metal plate members formed of the same material as the supporting plate 19A described above.

Through-holes are formed through each longitudinal end of the roller-supporting walls 51 and at four locations between the end through-holes. The through-holes formed in the ends of the roller-supporting walls 51 are belt roller-supporting through-holes 52A and 52B serving as bearings for rotatably supporting the belt-supporting rollers 37 and 38. Specifically, the belt-supporting rollers 37 and 38 are disposed on roller shafts 37A and 38A, respectively, that are received in the belt roller-supporting through-holes 52A and 52B.

The remaining four through-holes are transfer roller-supporting through-holes 52C serving as bearings for rotatably supporting transfer rollers 39. More specifically, the transfer rollers 39 are configured of metal roller shafts 39A covered with an electrically conductive rubber material. The transfer roller-supporting through-holes 52C receive the metal roller shafts 39A of the transfer rollers 39.

Screw through-holes 52E are formed in the upper edge on both ends of the roller-supporting wall 51. Positioning through-holes 52D are formed below the screw through-holes 52E. The positioning through-holes 52D are elongated vertically. Another screw through-hole 52F is formed in the middle part of the roller-supporting wall 51.

Screw-receiving parts 58 are formed in both left and right ends of each joining wall 56. The screw-receiving parts 58 have screw through-holes 58A formed therein at positions corresponding to the screw through-holes 52E. Positioning pieces 59 are formed on both left and right ends of each joining wall 56 at positions corresponding to the positioning through-holes 52D.

The positioning piece 59 at the left end of each joining wall 56 protrudes leftwardly from the left edge of the joining wall 56. Accordingly, the left-side roller-supporting wall 51 is mounted on the joining walls 56 from the left side thereof, that is, in the direction in which the paper-conveying belt 36 is mounted on the roller-supporting shafts 37 and 38.

Flange parts 53 and 57 are formed on the roller-supporting walls 51 and joining walls 56, respectively, along the entire lengths thereof. The flange parts 53 and 57 bend outward from the top edges of the roller-supporting walls 51 and joining walls 56.

A plate-shaped reinforcing wall 61 spans between the two roller-supporting walls 51 on the underside thereof. This construction improves the stiffness of the overall outer frame 50.

Screw-receiving parts 60 are formed in both left and right edges of the reinforcing wall 61. The screw-receiving parts 60 have screw through-holes 60A formed therein at positions corresponding to the screw through-holes 52F.

Further, the screw-receiving parts 58 are bent inward to follow the inner surface of the roller-supporting wall 51. The screw-receiving parts 60 are bent inward to follow the inner surface of the roller-supporting wall 51. The roller-supporting wall 51 is placed over the screw-receiving parts 58 and the screw-receiving part 60 from the left side thereof, that is, in the axial direction of the rollers. Screws 71 are inserted through the screw through-holes 52E into the screw through-holes 58A to fix the roller-supporting wall 51 to the screw-receiving parts 58. Another screw 72 is inserted through the screw through-hole 52F into the screw through-hole 60A to fix the roller-supporting wall 51 to the screw-receiving part 60. Thus, the screws 71 and 72 are screwed into the joining walls 56 and the plate-shaped reinforcing wall 61 to fix the roller-supporting wall 51 to the joining walls 56 and the plate-shaped reinforcing wall 61 from the left side thereof, that is, in the axial direction of the rollers.

In this way, all operations are performed in the same direction (from left to right direction). That is, the direction for mounting the paper-conveying belt 36 on the belt-supporting rollers 37 and 38 is identical to the direction for subsequently mounting the roller-supporting wall 51 on the joining wall 56, which is identical to the direction for fixing the roller-supporting wall 51 to the joining walls 56 and the plate-shaped reinforcing wall 61 (the direction for inserting the screws 71 and 72). Therefore, this structure greatly facilitates assembly and disassembly as the belt unit 35.

Further, when placing the roller-supporting wall 51 on the joining walls 56 so that the positioning pieces 59 are inserted through the respective positioning through-holes 52D, the screw through-holes 58A of the joining walls 56 are aligned with the screw through-holes 52E of the roller-supporting wall 51, the screw through-hole 60A of the plate-shaped reinforcing wall 61 is aligned with the screw through-hole 52F of the roller-supporting wall 51, and both ends of the roller-supporting wall 51 are supported by the joining walls 56. Therefore, a worker can freely insert the screws without needing to support the roller-supporting wall 51.

As shown in FIG. 3, an urging bracket 63 is also provided on the belt unit 35. The urging bracket 63 includes a base plate 64 extending in the longitudinal direction of the roller-supporting wall 51, a bearing 65 disposed on the outer surface of the base plate 64 in the rear region thereof, and a spring anchor 66 in the front region thereof.

The urging bracket 63 is mounted on the outer surface of the roller-supporting wall 51 with an end of the roller shaft 37A of the belt-supporting roller 37 inserted through the bearing 65. The urging bracket 63 is capable of moving in the front-to-rear direction with respect to the roller-supporting wall 51. A coil spring 68 has one end engaged in the respective positioning piece 59 of the joining wall 56 and the other end engaged in the spring anchor 66 of the urging bracket 63.

With this construction, the coil spring 68 applies an urging force to the belt-supporting roller 37 in the rear side for expanding the distance between the opposing belt-supporting rollers 37 and 38 to maintain the paper-conveying belt 36 in a taut state. Unlike the belt roller-supporting through-hole 52B, the belt roller-supporting through-hole 52A in the rear side is elongated in the longitudinal direction of the roller-supporting wall 51. This belt roller-supporting through-hole 52A functions as a guide rail that allows the belt-supporting roller 37 to slide in the longitudinal direction of the roller-supporting wall 51.

A fitting mechanism (not shown) is provided on the outer frame 50 and the supporting plate 19A of the main casing 2 (see FIG. 2) When the outer frame 50 of the belt unit 35 is set on the supporting plate 19A in its proper mounted position, the fitting mechanism immovably fixes the outer frame 50 with respect to the supporting plate 19A and, hence, the belt unit 35 with respect to the supporting plate 19A. When the outer frame 50 is mounted on the supporting plate 19A, the belt-supporting roller 38 on the upstream side in the paper-conveying direction (right side in FIG. 1) is connected to a drive transmission gear (not shown). When a motor (not shown) is driven, a driving force produced by the motor is transferred via the drive transmission gear to the belt-supporting roller 38, causing the paper-conveying belt 36 to move circuitously for conveying a sheet 3 on the top side in a front-to-rear direction. Hence, when sheets 3 are supplied one sheet at a time from the paper-feeding unit 4, as described above, the paper-conveying belt 36 conveys the sheet 3 along a paper-conveying path indicated by an arrow S (see FIG. 5).

The lower edges of the roller-supporting walls 51 and joining walls 56 are positioned slightly below the bottom surface of the paper-conveying belt 36. With this construction, the paper-conveying belt 36 is raised above the supporting plate 19A with a gap being formed therebetween when the belt unit 35 is mounted on the supporting plate 19A.

Figure 5:
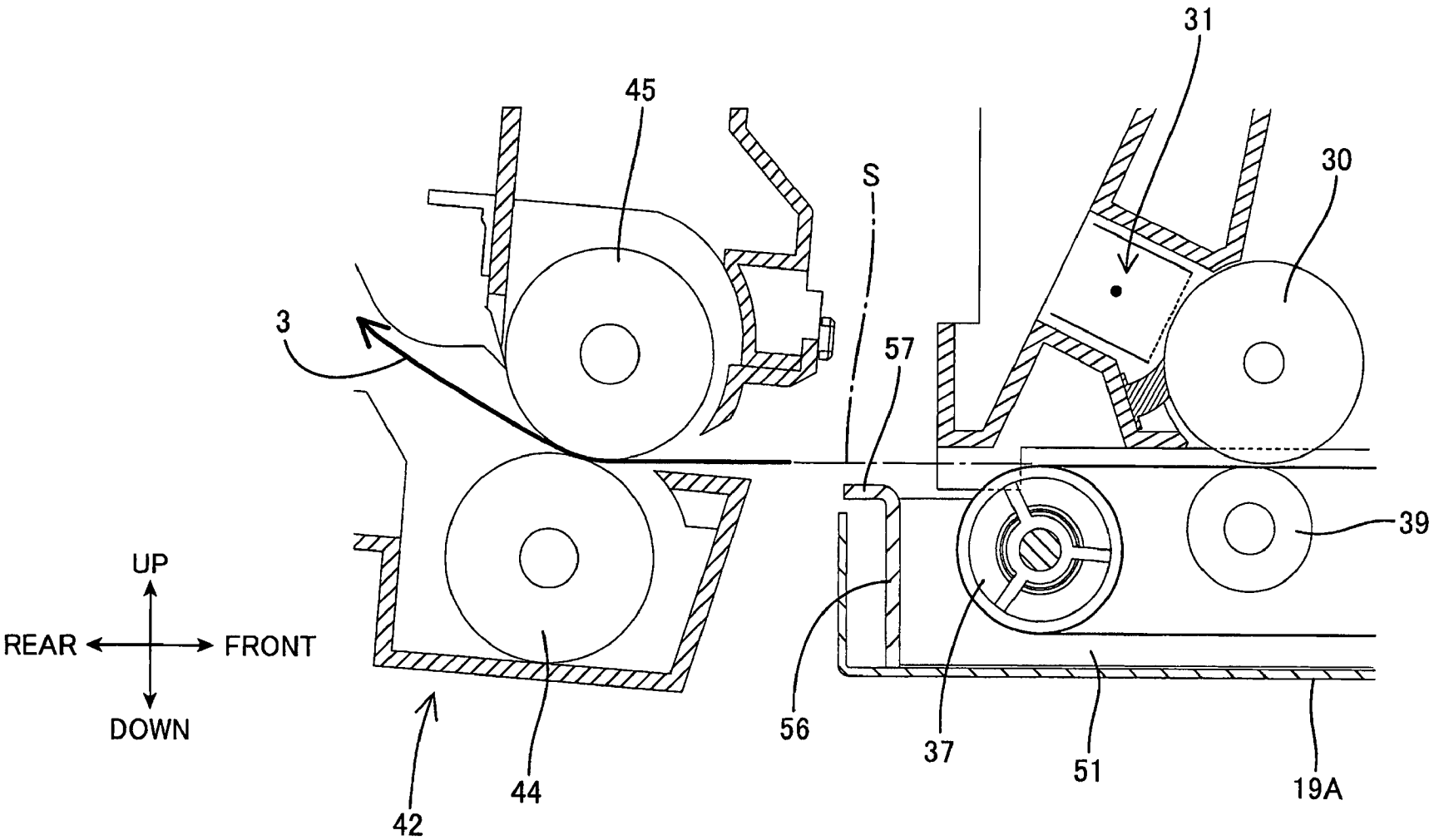
FIG. 5 is an enlarged view of the belt unit according to the first embodiment showing the rear end portion thereof.

FIG. 5 is an enlarged side cross-sectional view of the belt unit 35 showing the rear end thereof. As shown in the drawing, the upper edge of each flange part 57 formed on the joining wall 56 is set at a height slightly lower than the paper-conveying path S. If the top edge of the flange part 57 were to project into the paper-conveying path S, the flange part 57 could impede the conveyed paper. However, the construction of this embodiment prevents such occurrences.

Next, the image-forming unit 20 will be described.

As shown in FIG. 1, the image-forming unit 20 includes the accommodating section 21 for retaining four process units arranged in the front-to-rear direction. Each of the four process units includes the photosensitive drum 30, a Scorotron charger 31, a developer cartridge 22, and a cleaning brush 33.

The four developer cartridges 22 are detachably mounted in the accommodating section 21 and corresponding to the colors black, cyan, magenta, and yellow, respectively. Each developer cartridge 22 is configured of an accommodating case 23 having a box shape with an opening on the bottom side. A toner-accommodating chamber 24 is formed in the upper section of the accommodating case 23 for accommodating toner in the respective color. An agitator (not shown) is disposed in the toner-accommodating chamber 24. The agitator stirs toner inside the toner-accommodating chamber 24 when driven to rotate by a driving force inputted from a motor (not shown). The developer cartridge 22 also includes a supply roller 25, a developing roller 26, and a thickness-regulating blade 27 all disposed below the toner-accommodating chamber 24.

The supply roller 25 is rotatably supported in the accommodating case 23 and is configured of a metal roller shaft covered by a roller that is formed of an electrically conductive foam material. The supply roller 25 is driven to rotate by a driving force inputted from a motor (not shown).

The developing roller 26 is rotatably supported in the accommodating case 23 at a position diagonally below and rearward of the supply roller 25. The developing roller 26 contacts the supply roller 25 with pressure so that each is compressed to a degree. When the developer cartridge 22 is mounted in the accommodating section 21, the developing roller 26 is placed in contact with the respective photosensitive drum 30. The developing roller 26 is configured of a metal roller shaft 26A covered by a roller 26B that is formed of an electrically conductive rubber material. More specifically, the roller 26B of the developing roller 26 is formed of an electrically conductive urethane rubber or silicone rubber including fine carbon particles or the like, the surface of which rubber is coated with a urethane rubber or silicone rubber including fluorine. During a developing operation, a developing bias is applied to the developing roller 26. The developing roller 26 is driven to rotate by a driving force inputted from a motor (not shown).

The thickness-regulating blade 27 includes a main blade member formed of a metal leaf spring member, and a pressing part provided on the distal end of the main blade member. The pressing part has a semicircular cross section and is formed of an insulating silicone rubber. The thickness-regulating blade 27 is supported in the accommodating case 23 above the developing roller 26 so that the elastic force of the main blade member causes the pressing part to contact the developing roller 26 with pressure.

Toner discharged from the toner-accommodating chamber 24 by the agitator is supplied onto the developing roller 26 by the rotation of the supply roller 25. At this time, the toner is positively tribocharged between the supply roller 25 and the developing roller 26. As the developing roller 26 continues to rotate, the toner supplied onto the surface of the developing roller 26 passes beneath the pressing part of the thickness-regulating blade 27, at which time the pressing part regulates the toner carried on the developing roller 26 at a thin layer of uniform thickness.

The photosensitive drum 30 is configured of a main drum body 30A that is cylindrical in shape and has an outermost layer formed of a photosensitive layer of polycarbonate or the like with positive-charging nature; and a metal drum shaft 30B extending along the central axis of the main drum body 30A in the longitudinal direction thereof. As described above, four of the photosensitive drums 30 are provided to correspond to each of the colors. Each photosensitive drum 30 is disposed above the respective transfer roller 39 in the belt unit 35 such that the peripheral surface of the photosensitive drum 30 contacts the conveying surface of the paper-conveying belt 36. The photosensitive drums 30 are driven to rotate by a driving force inputted from a motor (not shown).

The charger 31 is disposed in opposition to the photosensitive drum 30 but separated a prescribed distance therefrom and is positioned diagonally above and rearward of the photosensitive drum 30. The charger 31 has a charging wire formed of tungsten or the like from which a corona discharge is generated to charge the entire surface of the photosensitive drum 30 with a uniform positive polarity.

The cleaning brush 33 is disposed in opposition to the photosensitive drum 30 so as to contact the rear side of the same.

A detailed description of the scanning unit 18 will not be included herein. However, four laser irradiation through-holes are formed in the bottom surface of the scanning unit 18 at regular intervals in the front-to-rear direction, as shown in FIG. 1. The scanning unit 18 is configured to irradiate laser beams Ls toward the respective photosensitive drums 30 via these through-holes based on prescribed image data.

With the laser printer 1 having this construction, as the photosensitive drum 30 rotates, the charger 31 charges the surface of the photosensitive drum 30 with a uniform positive polarity. Subsequently, the scanning unit 18 irradiates a laser beam Ls in a high-speed scan to form an electrostatic latent image on the surface of the respective photosensitive drum 30 that correspond to an image to be formed on the sheet 3.

Next, positively charged toner carried on the surface of the developing roller 26 comes into contact with the photosensitive drum 30 as the developing roller 26 rotates and is supplied to areas on the surface of the positively charged photosensitive drum 30 that have been exposed to the laser beam Ls and, therefore, have a lower potential. In this way, the latent image on the photosensitive drum 30 is developed into a visible toner image according to a reverse development process.

Next, the toner image carried on the surface of the photosensitive drum 30 is transferred onto the sheet 3 by a transfer bias applied to the transfer roller 39 as the sheet 3 conveyed by the paper-conveying belt 36 passes through a transfer position between the photosensitive drum 30 and the transfer roller 39. After a toner image has been transferred, the sheet 3 is conveyed to a fixing unit 42 described next.

The fixing unit 42 is disposed in the main casing 2 rearward of the belt unit 35. The fixing unit 42 includes a heating roller 43 and a pressure roller 44 disposed in confrontation with each other. The heating roller 43 and pressure roller 44 function to fix a toner image to the surface of the sheet 3 with heat. A pair of conveying rollers 45 are disposed downstream of the fixing unit 42 in the paper-conveying direction and positioned diagonally above and rearward of the fixing unit 42. A pair of discharge rollers 46 are disposed further downstream and above the conveying rollers 45 near the end of the paper-conveying path. A discharge tray 47 is formed on the top surface of the main casing 2 and has a front side that is substantially level, and a rear side that slopes downward toward the rear end.

After the toner image is fixed to the surface of the sheet 3, the conveying rollers 45 convey the sheet 3 to the discharge rollers 46 in the top of the main casing 2, and the discharge rollers 46 discharge the printed sheet 3 onto the discharge tray 47. When multiple sheets 3 are discharged, the sheets 3 form a stack on the discharge tray 47.

In the embodiment described above, the outer frame 50 encompasses the paper-conveying belt 36 on all of the front, rear, right, and left sides thereof. Hence, the entire belt unit 35 can be carried by gripping the outer frame 50 without directly touching the paper-conveying belt 36, thereby facilitating handling of the belt unit 35 and preventing the paper-conveying belt 36 from contacting other components and the like when the belt unit 35 is carried. Further, since the outer frame 50 also functions to support the rollers, the structure of the belt unit 35 is simplified compared to a construction that provides special supporting components.

The outer frame 50 is also configured of the same material as the supporting plate 19A on which the outer frame 50 is mounted. By using the same material to form the two components, the components expand and contract at the same rate even when ambient temperature changes, thereby minimizing strain generated in the fitting region and maintaining image quality.

Second Embodiment

Next, a second embodiment according to the invention will be described with reference to FIGS. 6 and 7. In the first embodiment described above, the outer frame 50 is configured of the pair of roller-supporting walls 51, and the pair of joining walls 56 spanning between corresponding ends of the roller-supporting walls 51. However, an outer frame 80 according to the second embodiment is divided into an upper frame 85, and a lower frame 81. Both the lower frame 81 and upper frame 85 are formed of a synthetic resin.

More specifically, the lower frame 81 has a bottom plate 82 formed large enough to cover the bottom surface of the paper-conveying belt 36, and side walls 83 provided around the entire periphery of the bottom plate 82. That is, the side walls 83 surround all of the front, left, right, and rear sides of the paper-conveying belt 36. The upper frame 85 conforms to the external shape of the lower frame 81 so that the upper frame 85 can be stacked on the side walls 83 of the lower frame 81. Thus, the upper frame 85 surrounds all of the front, left, right, and rear sides of the paper-conveying belt 36.

Two first casings 89 are mounted on the lower frame 81. Each pair of two adjacent transfer rollers 39 is rotatably supported in a corresponding first first casing 89.

The side walls 83 of the lower frame 81 include side walls 84 extending in the paper-conveying direction. Lower bearing parts 84A and 84B are formed in the top edges of the side walls 84 at positions corresponding to the roller shafts 37A and 38A. Each lower bearing part 84A, 84B has a partially-cut-out circular cylindrical shape that surrounds its central axis by 180 degrees. Additional four lower bearing parts 84C are formed as depressions in the top edges of the side walls 84 at positions corresponding to the roller shafts 39A. Upper bearing parts 86A and 86B are formed in the upper frame 85 at positions corresponding to the lower bearing parts 84A and 84B. Each upper bearing part 86A, 86B has a partially-cut-out circular cylindrical shape that surrounds its central axis by 180 degrees. Additional four upper bearing parts 86C are formed as depressions in the upper frame 81 at positions corresponding to the lower bearing parts 84C.

When the upper frame 85 is stacked on the lower frame 81, the bearing parts are aligned. That is, the lower bearing parts 84A are aligned with the upper bearing parts 86A, while the lower bearing parts 84B are aligned with the upper bearing parts 86B, forming roller-supporting through-holes for receiving the roller shafts 37A and 38A. The additional lower bearing parts 84C are aligned with the additional upper bearing parts 86C, forming roller-supporting through-holes for receiving the roller shafts 39A.

Now, a roller-axis imaginary plane is defined as a plane where roller axes L2 and L3 of the belt-supporting rollers 37 and 38 (FIG. 7) are located when the belt-supporting rollers 37 and 38 are rotatably supported by the bearing parts 84A, 86A, 84B, and 86B. The imaginary plane matches the plane of drawing of FIG. 7. In this example, the side walls 84 are designed to have their top edges extend on an imaginary plane that is parallel to the roller-axis imaginary plane. Accordingly, the upper frame 85 is stacked on the lower frame 81 in a direction orthogonal to the roller-axis imaginary plane.

However, the side walls 84 may be designed to have at least a part of their top edges extend on another imaginary plane that is not parallel to but that is slightly shifted angularly from the roller-axis imaginary plane. In this case, the upper frame 85 is stacked on the lower frame 81 in a direction that intersects the roller-axis imaginary plane at an angle different from 90 degrees.

Figure 6:
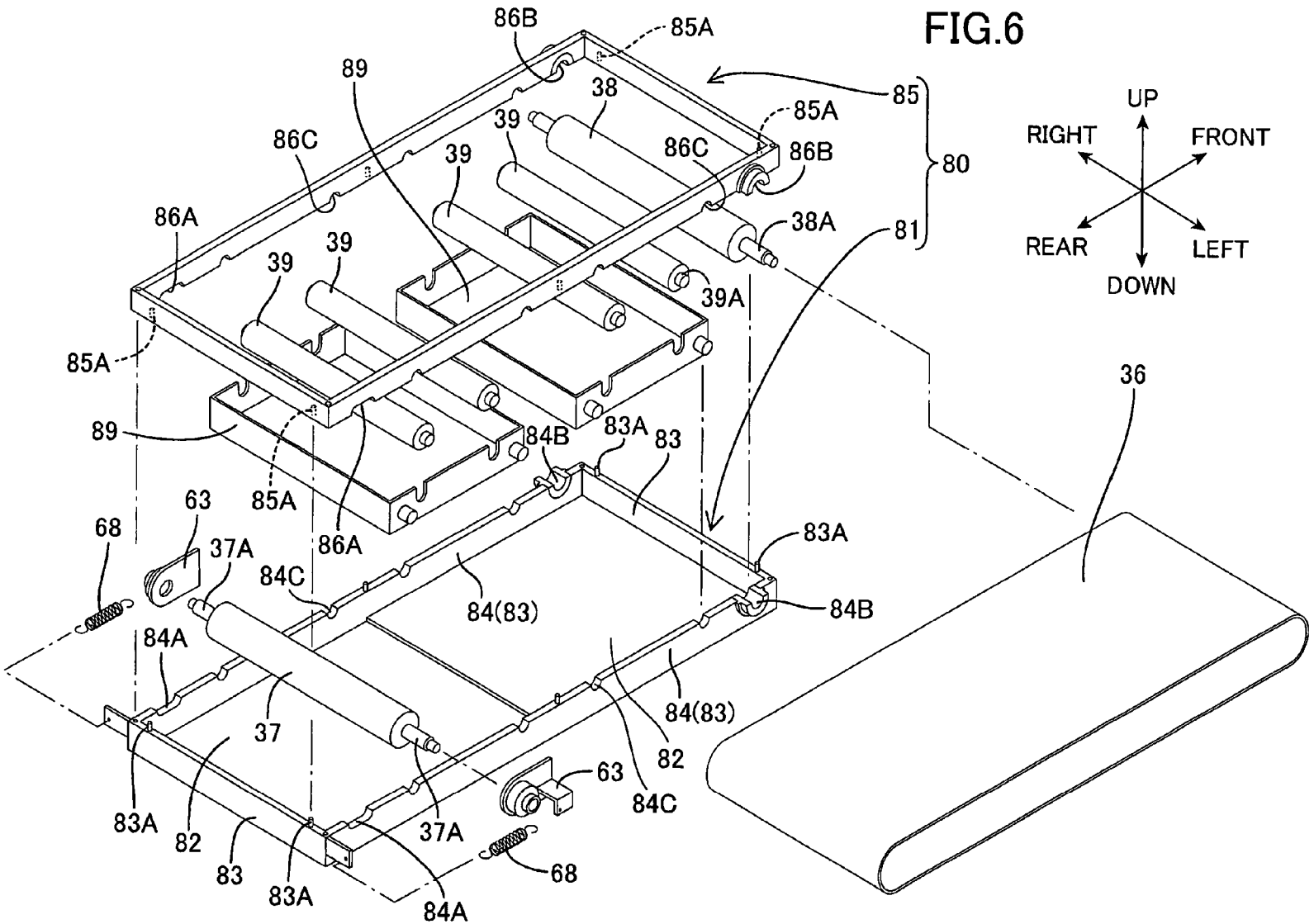
FIG. 6 is an exploded perspective view of a belt unit according to a second embodiment.
Figure 7:
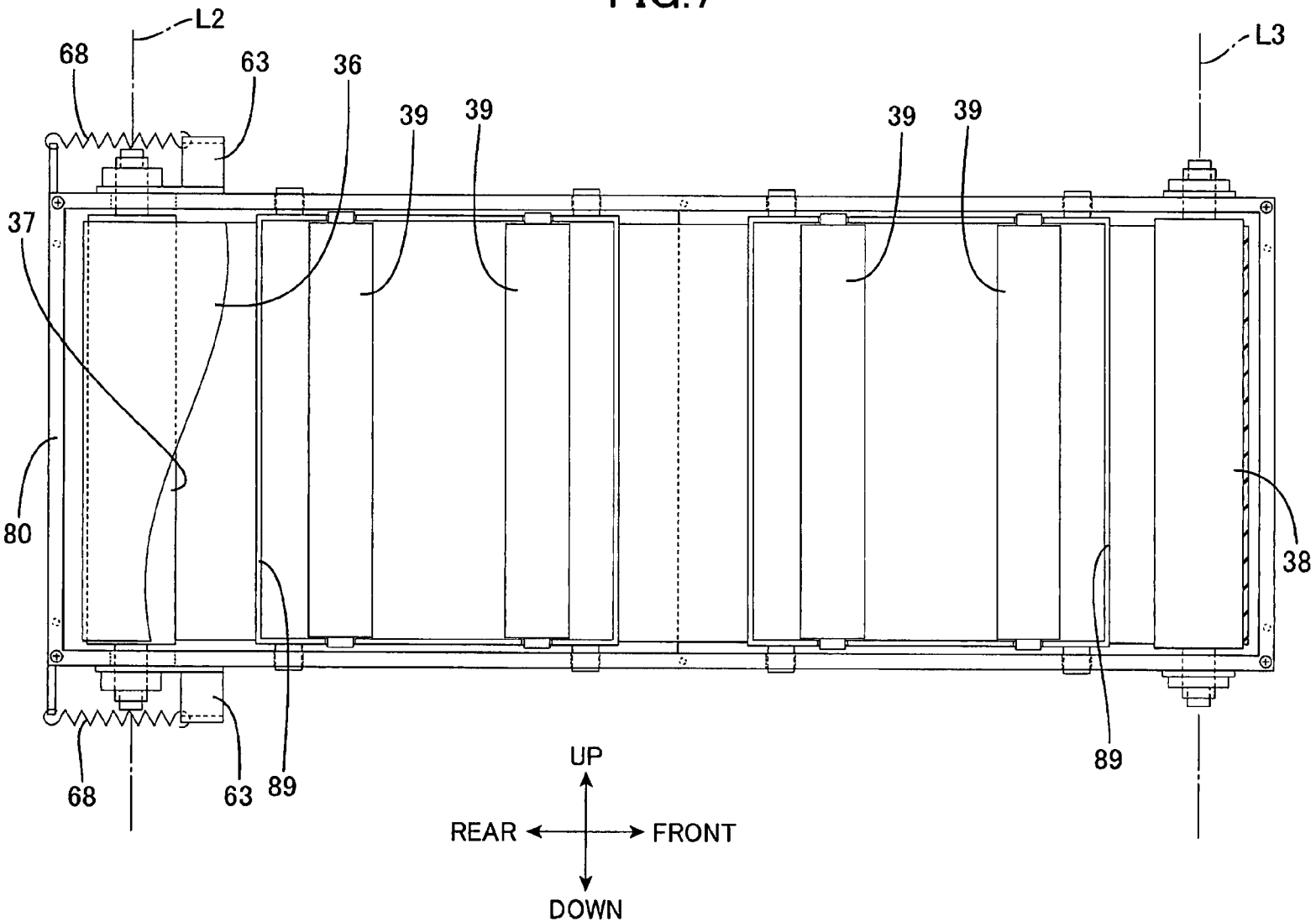
FIG. 7 is a plan view of the belt unit according to the second embodiment.

On the lower frame 81 shown in FIG. 6, upper protruding bosses 83A are formed near the four corners of the side walls 83, while insertion holes 85A are formed in the upper frame 85 at positions corresponding to the bosses 83A. By inserting the bosses 83A into the corresponding insertion holes 85A, the frames 81 and 85 can be positioned relative to each other. In this state, the frames 81 and 85 can be fixed together by inserting screws from above, for example, or using some other fixing mechanisms.

In order to assemble the outer frame 80 having this construction, the lower frame 81 is first placed on a work surface. Next, the rollers 37, 38, the rollers 39 in the first casings 89, and the paper-conveying belt 36 are arranged on top of the lower frame 81. After completing this arrangement, the upper frame 85 is stacked on top of the lower frame 81 and fixed thereto. Through this simple construction, assembly of the primary components constituting the belt unit 35 is completed. In other words, the belt unit 35 can be assembled easily by assembling the primary components from a position above the belt unit 35, thereby facilitating the assembly operation.

With this construction, the rollers 37, 38, and 39 can be supported by the outer frame 80 simultaneously when the outer frame 80 is assembled. Hence, the operations of assembly and disassembly of the belt unit 35 having this structure are easy.

As described above, the bottom plate 82 is provided on the lower frame 81 for covering the lower surface side of the paper-conveying belt 36, thereby effectively protecting the paper-conveying belt 36.

Each pair of adjacent transfer rollers 39 is rotatably supported in the first casing 89. This construction reduces the number of required assembly steps and improves the ease of assembly operations compared to a construction that mounts the transfer rollers 39 individually in the lower frame 81. Since the remaining construction of the image-forming apparatus is identical to that described in the first embodiment, like parts and components have been designated with the same reference numerals to avoid duplicating description.

First Modification of Second Embodiment

Figure 8A:
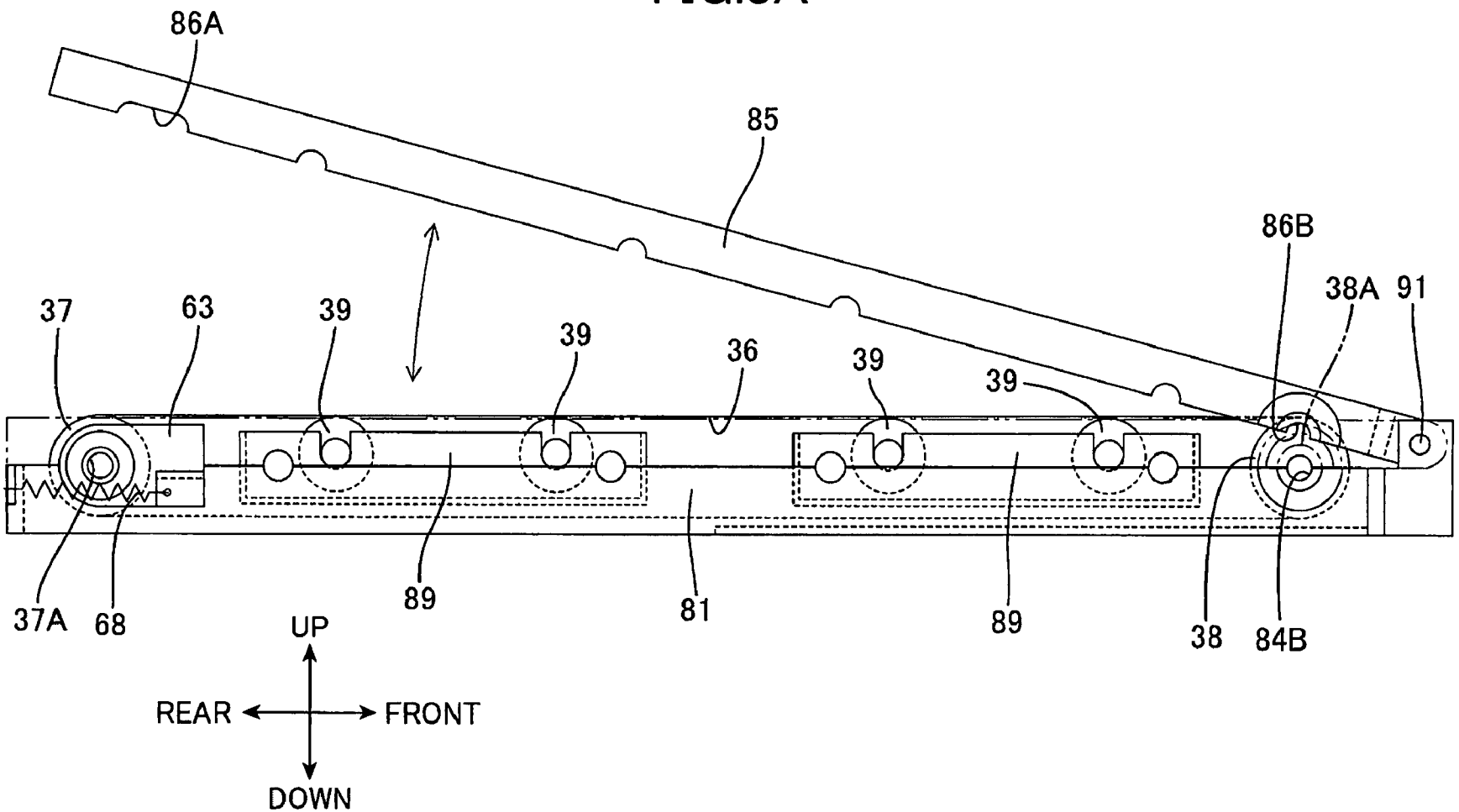
FIG. 8A is a side view of a belt unit according to a first modification of the second embodiment.

Next, a first modification of the second embodiment of the invention will be described with reference to FIG. 8A.

While the outer frame 80 is divided into two independent frames 81 and 85 in the second embodiment described above, the frames 81 and 85 according to the first modification of the second embodiment are rotatably joined at the same end (front end) by a hinge shaft 91 that is provided extending in the right-to-left direction.

With this construction, the upper frame 85 can be rotated about the hinge shaft 91 to an open state with respect to the lower frame 81 in order to mount the corresponding rollers 37, 38, and 39, as well as the paper-conveying belt 36, in the frames 81 and 85. Subsequently, the rollers 37, 38, and 39 and the paper-conveying belt 36 can be protected within the frames 81 and 85 by rotating the upper frame 85 in a closing direction until the ends of the frames 81 and 85 opposite the hinge shaft 91 meet.

By enabling the frames 81 and 85 to open and close with respect to each other through a rotating operation about the hinge shaft 91, this construction further facilitates assembly and disassembly operations. That is, the belt unit 35 can be assembled and disassembled by rotating the upper and lower frames 85 and 81 relative to each other about the hinge shaft 91, thereby facilitating assembly and disassembly.

Second Modification of Second Embodiment

Next, a second modification of the second embodiment of the invention will be described with reference to FIG. 8B to FIG. 8F.

Figure 8B:
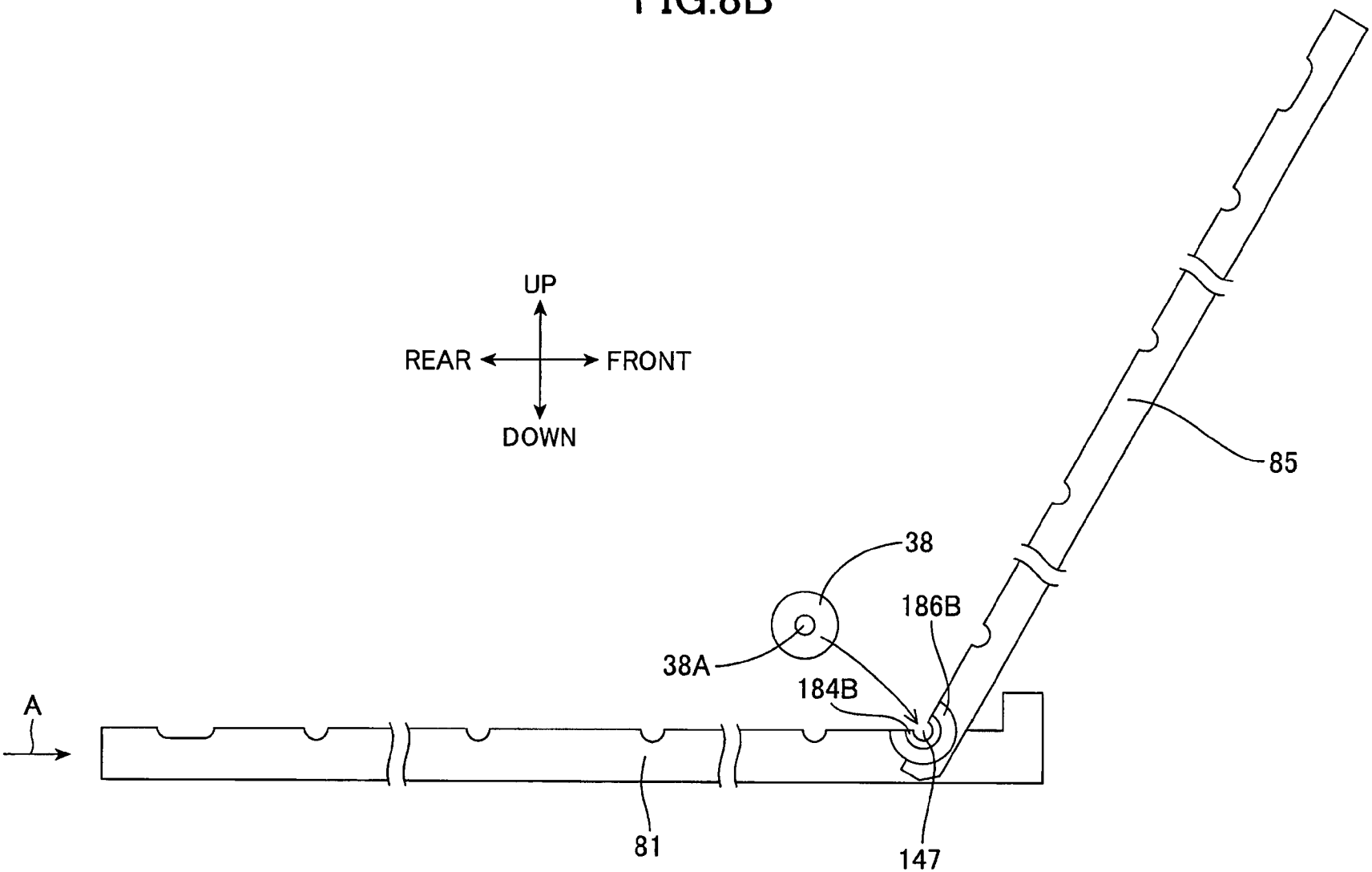
FIG. 8B is an explanatory diagram illustrating a belt unit according to a second modification of the second embodiment.

According to the first modification of the second embodiment, the frames are rotatable about the hinge shaft 91 that is positioned near the end of the frames 81 and 85. Contrarily, according to the present modification, the frames are rotatable about an axis that is positioned in roller-supporting through-holes 147 as shown in FIG. 8B. When the upper frame 85 is rotated open over the lower frame 81, the roller-supporting through-holes 147 open partially. The roller shaft 38A of the belt-supporting roller 38 is fitted into the roller-supporting holes 147 through the open part thereof.

The arrangement of this modification will be described below in greater detail with reference to FIG. 8B to FIG. 8F.

Figure 8C:
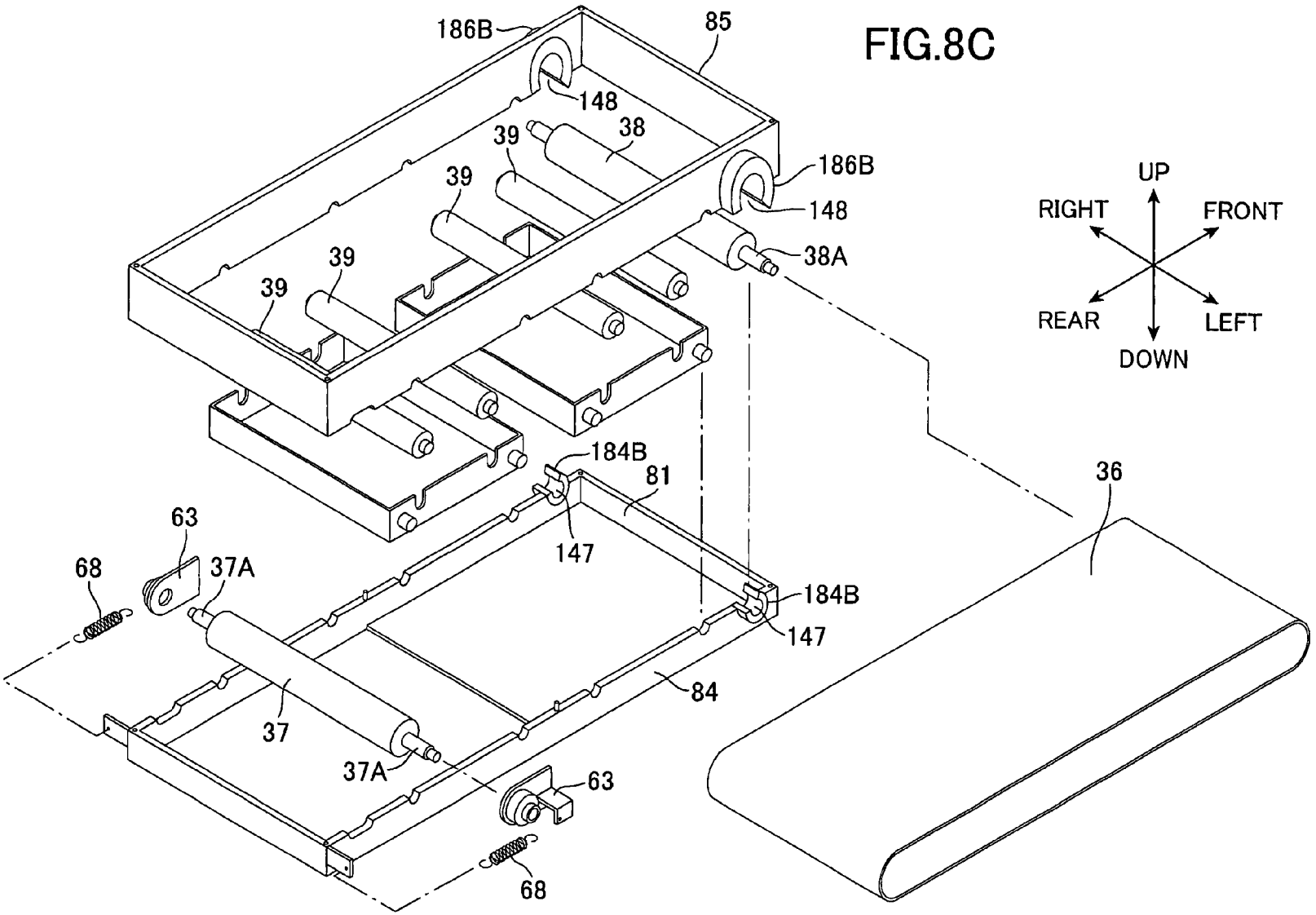
FIG. 8C is an exploded perspective view of the belt unit according to the second modification of the second embodiment.

As shown in FIG. 8C, the belt unit 35 of this modification is the same as that of the second embodiment shown in FIG. 6 except that lower bearing parts 184B are provided on the lower frame 81 in place of the lower bearing parts 84B, that upper bearing parts 186B are provided on the upper frame 85 in place of the upper bearing parts 86B, that no upper protruding bosses 83A are provided on the lower frame 81, and that no insertion holes 85A are formed in the upper frame 85.

Figure 8D:
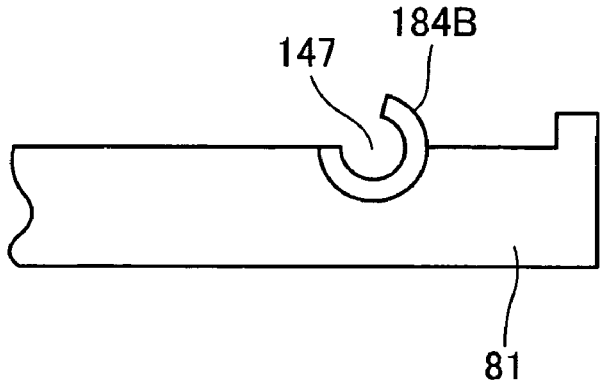
FIG. 8D is an explanatory diagram illustrating a lower bearing part provided on a lower frame according to the second modification of the second embodiment.

According to the second embodiment, the lower bearing part 84B has a partially-cut-out circular cylindrical shape that surrounds its central axis by 180 degrees. Accordingly, no part of the lower bearing part 84B is projected from the top edge of the lower frame 81. Contrarily, according to this modification, as shown in FIG. 8C and FIG. 8D, the lower bearing part 184B has a partially-cut-out circular cylindrical shape that surrounds its central axis by about 240 degrees. Accordingly, about 60 degree part of the lower bearing part 184B is projected from the top edge of the lower frame 81. The lower bearing part 184B defines the roller-supporting through-hole 147 about its central axis.

Figure 8E:
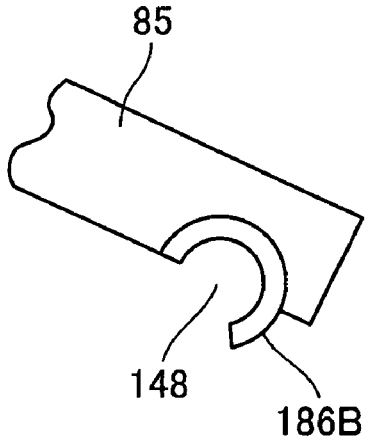
FIG. 8E is an explanatory diagram illustrating an upper bearing part provided on an upper frame according to the second modification of the second embodiment.

Similarly, According to the second embodiment, the upper bearing part 86B has a partially-cut-out circular cylindrical shape that surrounds its central axis by 180 degrees. Accordingly, no part of the upper bearing part 86B is projected from the lower edge of the upper frame 85. Contrarily, according to this modification, as shown in FIG. 8C and FIG. 8E, the upper bearing part 186B has a partially-cut-out circular cylindrical shape that surrounds its central axis by about 240 degrees. Accordingly, about 60 degree part of the upper bearing part 186B is projected from the lower edge of the upper frame 85. The upper bearing part 186B defines a lower-bearing-part supporting through-hole 148 about its central axis.

The radius of curvature in the partially-cut-out circular cylindrical shape of the upper bearing part 186B is slightly greater than that in the partially-cut-out circular cylindrical shape of the lower bearing part 184B.

Figure 8F:
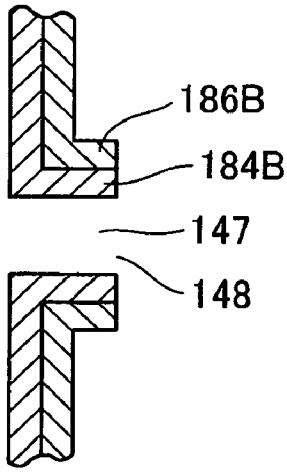
FIG. 8F is a sectional view of an essential portion of the upper and lower bearing parts that are rotatably engaged with each other, when viewed from the rear side as indicated by an arrow A in FIG. 8B.

The upper frame 85 is mounted on the lower frame 81, with the lower bearing part 184B being rotatably fitted in the lower-bearing-part supporting through-hole 148 of the upper bearing part 186B as shown in FIG. 8B and FIG. 8F. The lower bearing part 184B is positioned as being coaxial with the upper bearing 186B. Accordingly, as shown in FIG. 8B, the upper frame 85 can rotate with respect to the lower frame 81 about the central axis of the lower and upper bearing parts 184B and 186B. When the upper frame 85 is opened with respect to the lower frame 81 as shown in FIG. 8B, the roller-supporting through-hole 147 is opened and the roller shaft 38A of the belt-supporting roller 38 can be forced in the roller-supporting through-hole 147 on the upper and lower bearing parts 186B and 184B. When the upper frame 85 is closed with respect to the lower frame 81, the roller-supporting through-hole 147 is closed and the roller shaft 38A is rotatably supported in the roller-supporting through-hole 147 by the upper and lower bearing parts 186B and 184B.

Thus, the bearing parts 184B and 186B are used both for rotating the frames 81 and 85 and for supporting the roller 38, thereby reducing the number of required parts and reducing the overall manufacturing costs. The overall belt unit 35 can be made compact.

Third Embodiment

Figure 9:
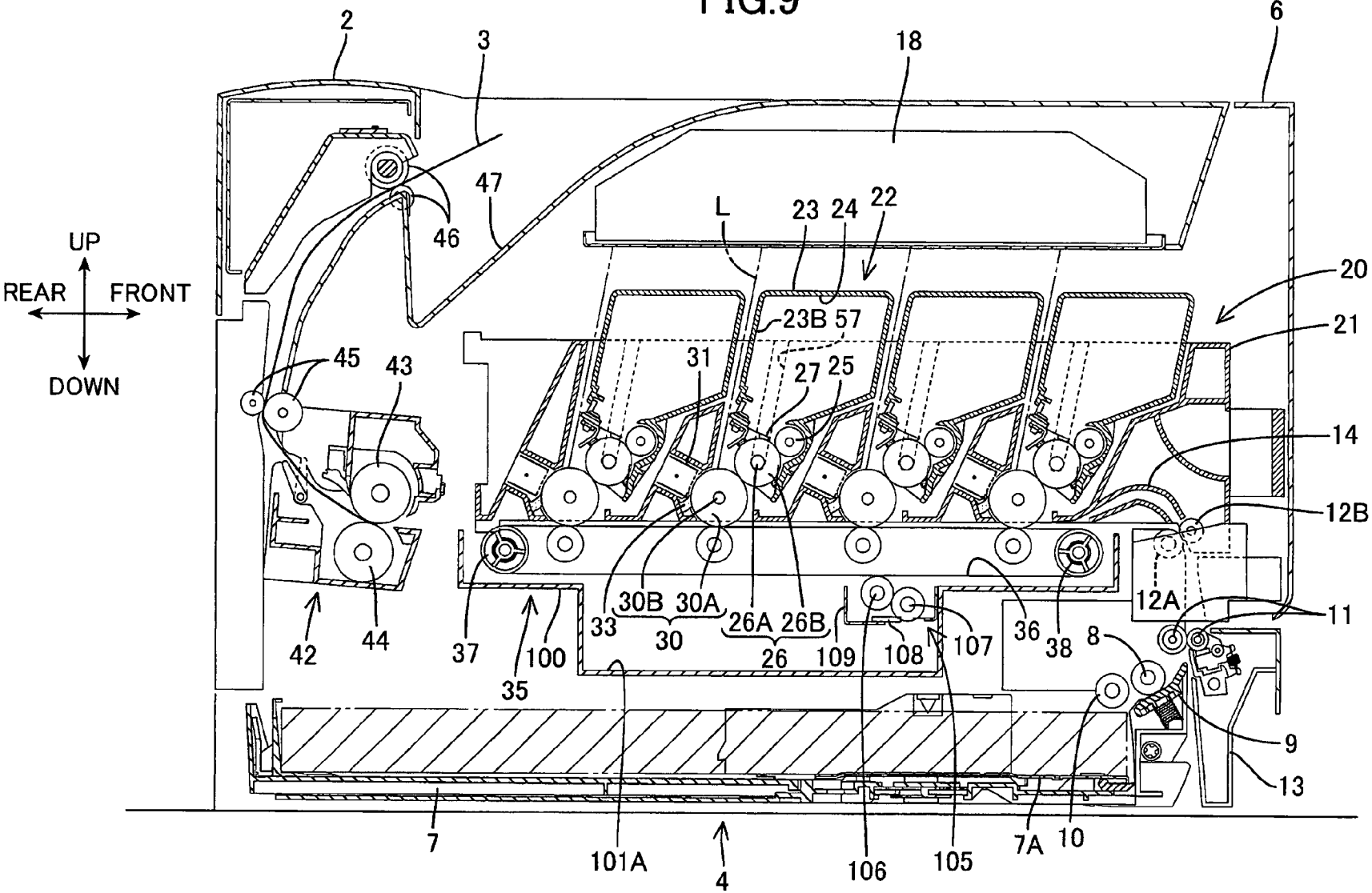
FIG. 9 is a side cross-sectional view of a laser printer according to a third embodiment.
Figure 10:
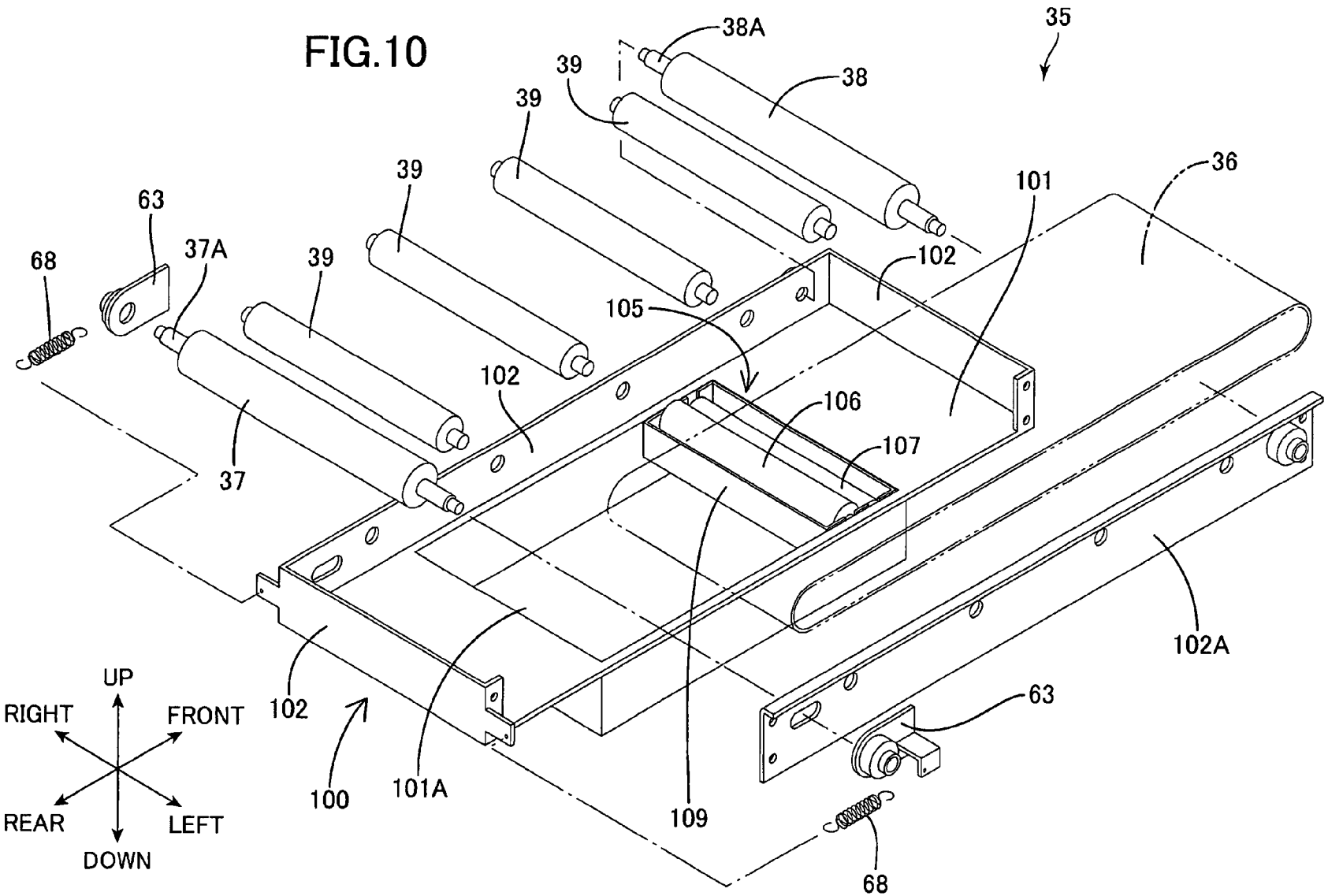
FIG. 10 is an exploded perspective view of a belt unit according to the third embodiment.

Next, a third embodiment of the invention will be described with reference to FIGS. 9 and 10.

The laser printer according to the third embodiment differs from the first embodiment with the addition of a cleaning unit 105. The cleaning unit 105 is for cleaning the paper-conveying belt 36 primarily by removing toner deposited on the belt. The cleaning unit 105 can clean the paper-conveying belt 36 also by removing paper dust. The cleaning unit 105 can also clean the paper-conveying belt 36 by removing toner patches when the toner patches are formed on the belt in order to adjust color density.

Further, an outer frame 100 according to the third embodiment includes an accommodating section 101A for accommodating the cleaning unit 105. The outer frame 100 is formed of a synthetic resin. As shown in FIG. 10, the outer frame 100 includes a bottom wall 101, and side walls 102 provided on the outer edges of the bottom wall 101 for encompassing the paper-conveying belt 36. Thus, the side walls 102 are located surrounding all of the front, left, right, and rear sides of the paper-conveying belt 36. One of these side walls 102 is a detachable side wall 102A that is located on the left side edge of the bottom wall 101 and that can be pulled off the outer frame 100 in the axial direction of the roller shafts of the rollers 37, 38, and 39. The detachable side wall 102A confronts the left side of the paper-conveying belt 36.

The accommodating section 101A is formed in the front-to-rear center of the laser printer 1 and projects downward in the bottom wall 101. The accommodating section 101A serves to accommodate the cleaning unit 105 therein. The cleaning unit 105 includes a second casing 109 that is box-shaped with an open top surface and, within the second casing 109, a cleaning roller 106, a recovery roller 107, and a cleaning blade 108.

Residual toner, paper dust, and the like on the paper-conveying belt 36 becomes deposited on the cleaning roller 106 when passing thereby. The toner and paper dust is subsequently transferred onto the recovery roller 107 and scraped off of the recovery roller 107 by the cleaning blade 108. Toner and paper dust scraped off by the cleaning blade 108 is collected in the second casing 109. Since the remaining structure of the laser printer is identical to the laser printer 1 of the first embodiment, like parts and components have been designated with the same reference numerals to avoid duplicating description.

This construction prevents toner, paper dust, and the like from remaining deposited on the paper-conveying belt 36, thereby maintaining good printing quality. Further, since the cleaning unit 105 is not exposed, this construction effectively protects the cleaning unit 105. In addition, the recovered toner and the like does not escape from the laser printer.

While the invention has been described in detail with reference to the above aspects thereof, it would be apparent to those skilled in the art that various changes and modifications may be made therein without departing from the spirit of the invention.

For example, in the above description, the belt units 35 function to convey paper. However, the belt units 35 may be modified to other belts. For example, the belt units 35 may be modified to an intermediate transfer belt 120 that is provided in an intermediate transfer tandem system shown in FIG. 11(*a*), wherein electrostatic latent images are formed on photosensitive drums 122, the electrostatic latent images are developed into toner images by toner supplied by developing rollers 124 mounted in developing cartridges 126, the toner images are transferred from the photosensitive drums 122 onto the intermediate transfer belt 120, and are then transferred from the intermediate transfer belt 120 onto a sheet of paper or another recording medium by using a transfer roller 128.

Figure 11A:
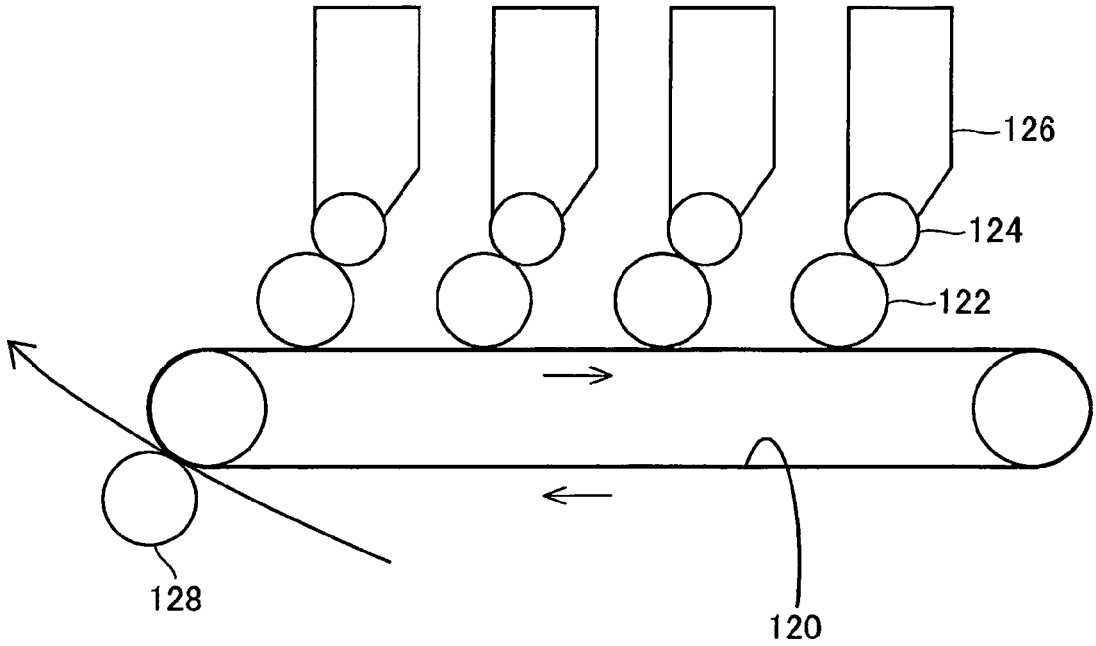
FIG. 11(*a*) is an explanatory diagram showing an intermediate transfer belt.
Figure 11B:
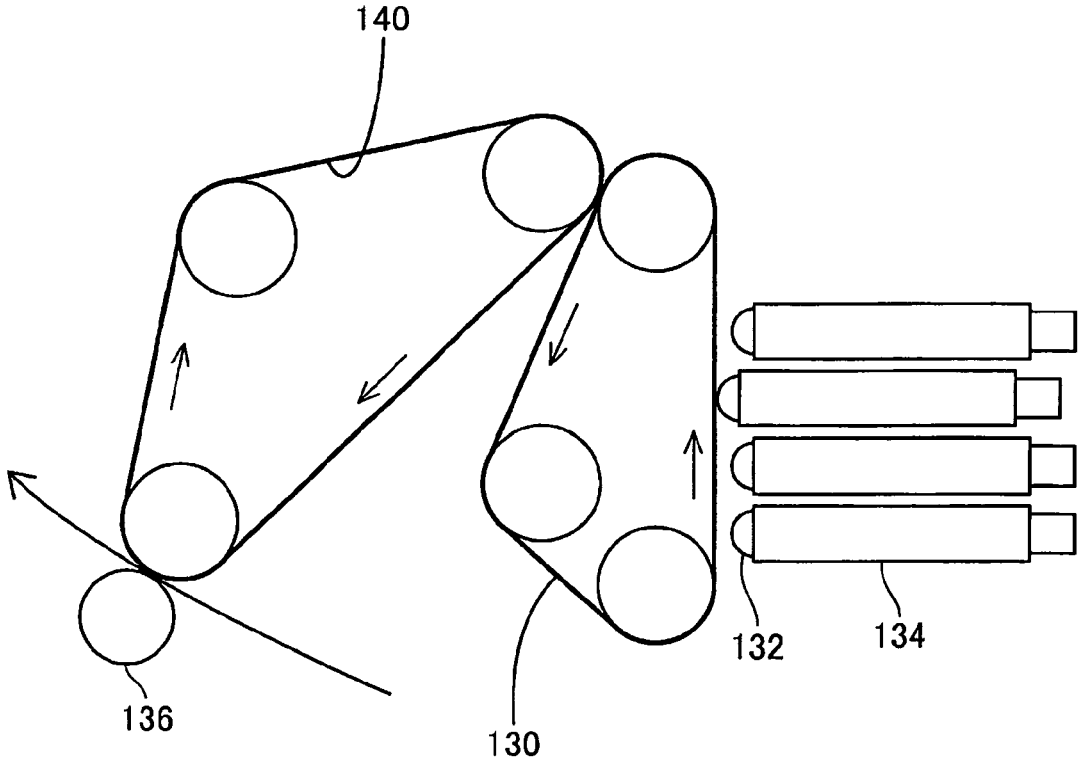

The belt units 35 may be modified to a photosensitive belt 130 or an intermediate transfer belt 140 used in a four-cycle system shown in FIG. 11(*b*), in which electrostatic latent images are formed on the photosensitive belt 130, the electrostatic latent images are developed into toner images by toner supplied from developing rollers 132 mounted in developing cartridges 134, the toner images are transferred from the photosensitive belt 130 onto the intermediate transfer belt 140, and are then further transferred from the intermediate transfer belt 140 onto a sheet of paper or another recording medium by using a transfer roller 136.

In the above description, the belt-supporting roller 38 disposed on the upstream side of the paper-conveying direction in the belt units 35 is configured as the drive roller. However, the belt-supporting roller 37 on the downstream side may instead be configured as the drive roller. In this case, the belt-supporting roller 38 on the upstream side in the paper-conveying direction should be slidably supported, and the coil springs 68 for providing belt tension should urge the belt-supporting roller 38 toward the upstream side.

In the first embodiment, the pair of roller-supporting walls 51 extend substantially perpendicularly to the roller axes of the rollers 37, 38, and 39. It is, however, sufficient that the pair of roller-supporting walls 51 extend in a direction intersecting the rotational axes of the rollers 37, 38, and 39. The same is applicable to the pair of roller-supporting sections of the upper and lower frames 85 and 81 in the second embodiment and its modification. The same is applicable also to the detachable side wall 102A and the right-side part of the side walls 102 that opposes the detachable side wall 102A in the third embodiment.

What is claimed is:

1. A belt unit that is detachably mountable in an image-forming apparatus, comprising:

at least two rollers, each having a roller shaft;

an endless belt looped around the two rollers; and an outer frame disposed around the endless belt and having two roller-supporting walls rotatably supporting the rollers therebetween, the roller shafts of the rollers extending in a direction intersecting the roller-supporting walls, wherein the outer frame includes a first frame and a second frame stacked in a direction intersecting a plane defined by axes of the roller shafts;

bearings disposed in opposing parts of the first and second frames, the bearings having roller-supporting through-holes formed therein that are aligned when the two frames are stacked together to support the roller shafts; and a joining member that rotatably joins the first and second frames with each other.

2. A belt unit according to claim 1, wherein the endless belt has a pair of opposite side portions that are defined as being located between the two rollers, and wherein the outer frame further comprises joining walls that join corresponding ends of the roller-supporting walls, thereby surrounding the entire periphery of the endless belt, while allowing at least one of the pair of opposite side portions of the endless belt to be exposed.

3. A belt unit according to claim 1, wherein the first and second frames are rotatably joined with each other via the bearings.

4. A belt unit according to claim 1, wherein the outer frame further has a main frame portion, at least one of the roller-supporting walls being detachably mounted to the main frame portion in the axial direction of the roller shafts.

5. A belt unit according to claim 1, wherein the endless belt has first and second side portions that are defined between the two rollers and that are apart from each other in a direction substantially perpendicularly to the roller shafts, and wherein the outer frame further includes an additional frame portion confronting one of the first and second side portions of the endless belt.

6. A belt unit according to claim 1, further comprising:

an accommodating section disposed in the outer frame; and a cleaning unit accommodated in the accommodating section and cleaning the endless belt.

7. A belt unit according to claim 1, wherein the outer frame further comprises joining walls that join corresponding ends of the roller-supporting walls, wherein the endless belt has first and second side portions that are defined between the two rollers, a conveying path conveying a recording medium being provided along the first side portion, and wherein a gap is formed between each joining wall and the conveying path.

8. A belt unit according to claim 1, further comprising a bottom frame that is integrally formed with the outer frame, the bottom frame covering a lower surface side of the endless belt.

9. A belt unit according to claim 1, wherein the outer frame comprises the roller-supporting walls, and joining walls that join corresponding ends of the roller-supporting walls, wherein when the belt unit is mounted in the image-forming apparatus, an upper end of each joining wall is located below the upper surface side of the endless belt.

10. A belt unit according to claim 1, wherein the image-forming apparatus in which the belt unit is employed has a main casing with a supporting part that supports the belt unit mounted in the main casing; and the outer frame is formed of the same material as the supporting part in the main casing of the image-forming apparatus.

11. An image-forming apparatus, comprising:

a main casing;

an image forming unit detachably mounted in the main casing; and a belt unit that is detachably mounted in the main casing, the belt unit comprising:

at least two rollers, each having a roller shaft;

an endless belt looped around the two rollers;

an outer frame disposed around the endless belt and having two roller-supporting walls rotatably supporting the rollers therebetween, the roller shafts of the rollers extending in a direction intersecting the roller-supporting walls;

wherein the main casing has a supporting part that supports the outer frame mounted thereon; and wherein the outer frame is formed of the same material as the supporting part in the main casing.

12. An image-forming apparatus as claimed in claim 11, wherein the image forming unit forms the image on the endless belt, further comprising a transfer member that transfers the image from the endless belt onto a recording medium.

13. An image-forming apparatus as claimed in claim 11, wherein the endless belt conveys a recording medium, on which the image is formed by the image forming unit.

14. An image-forming apparatus as claimed in claim 13, wherein the endless belt defines a medium-conveying path, along which the endless belt conveys the recording medium; and the outer frame further comprises joining walls that join corresponding ends of the roller-supporting walls, a gap being formed between the paper-conveying path and the joining walls.

15. An image-forming apparatus, comprising:

a main casing;

an image forming unit detachably mounted in the main casing; and a belt unit that is detachably mounted in the main casing, the belt unit comprising:

at least two rollers, each having a roller shaft;

an endless belt looped around the two rollers;

an outer frame disposed around the endless belt and having two roller-supporting walls rotatably supporting the rollers therebetween, the roller shafts of the rollers extending in a direction intersecting the roller-supporting walls;

wherein the outer frame includes a first frame and a second frame stacked in a direction intersecting a plane defined by axes of the roller shafts; and bearings disposed in opposing parts of the first and second frames, the bearings having roller-supporting through-holes formed therein that are aligned when the two frames are stacked together to support the roller shafts, wherein one of the at least two rollers rotatably joins the first and second frames with each other.

* * * * *